US005884933A

United States Patent [19]

Trott

[11] Patent Number: 5,884,933

[45] Date of Patent: Mar. 23, 1999

[54] SNOWBOARD/SNOWSHOE

[76] Inventor: Geoffrey G. Trott, 2482 Silkwood Ct., Spring Hill, Fla. 34606

[21] Appl. No.: 692,722

[22] Filed: Aug. 7, 1996

[51] Int. Cl.[6] ..... A63C 5/02

[52] U.S. Cl. ..... 280/603; 280/14.2; 36/122

[58] Field of Search ..... 280/7.1, 14.1, 280/14.2, 16, 28.16, 603, 607, 609; 36/122, 123, 124; 441/74, 68

[56] References Cited

U.S. PATENT DOCUMENTS

| | | | |
|---|---|---|---|
| 3,506,279 | 4/1970 | Lambert | 280/14.1 |
| 3,593,356 | 7/1971 | Schmalfeldt | 441/74 |
| 3,861,698 | 1/1975 | Greig | 36/122 |
| 4,138,128 | 2/1979 | Criss | 280/16 |
| 4,163,565 | 8/1979 | Weber | 280/14.2 |
| 4,221,394 | 9/1980 | Campbell | 280/14.2 |
| 4,403,785 | 9/1983 | Hottel | 280/14.2 |
| 4,871,337 | 10/1989 | Harris | 441/74 |
| 4,951,960 | 8/1990 | Sadler | 280/607 |
| 5,109,616 | 5/1992 | Lush | 36/124 |
| 5,249,816 | 10/1993 | Southworth | 280/14.2 |
| 5,542,197 | 8/1996 | Vincent | 36/122 |
| 5,618,051 | 4/1997 | Kobylenski et al. | 280/14.2 |

FOREIGN PATENT DOCUMENTS

| | | | |
|---|---|---|---|
| 2429145 | 2/1980 | France | 441/74 |
| 2613948 | 10/1988 | France | 280/603 |
| 3325819 | 12/1984 | Germany | 441/74 |

*Primary Examiner*—Brian L. Johnson
*Assistant Examiner*—Frank Vanaman
*Attorney, Agent, or Firm*—Terrance L. Siemens

[57] ABSTRACT

A pair of snowshoes, or skis, are utilized by the user to go up the slope of a hill. A binding bracket is carried separately to the top of the slope when the user then mounts the binding bracket to the back ends of each snowshoe and thus provides a singular snowboard for the user to slide down the slope.

6 Claims, 3 Drawing Sheets

SNOWBOARD/SNOWSHOE

BACKGROUND OF THE INVENTION

1. Field of the Invention

The present invention relates to a snowboard/snowshoe invention More specifically, it relates to a snowshoe for use in going up a snow slope and a snowboard for descending a snow slope.

2. Description of the Prior Art

As will be seen, the simplicity and effectiveness of my invention is not rivaled in the prior art.

U.S. Pat. No. 4,138,128 to Criss issued on Feb. 6, 1979 shows a pair of skis mounted with both raised edges to the front and an elongated riding platform mounted to the pair of skis by brackets with both skis separated by a gap. By contrast, the device of the instant invention shows both skis mounted back-to-back without a gap intervening between the skis.

U.S. Pat. No. 4,221,394 issued to Campbell issued on Sep. 9, 1980 shows a snow vehicle with a pair of skis secured by a riding platform mounted by brackets to each ski. Both skis a separated by a gap. By contrast, the device of the instant invention show skis mounted back-to-back with no gap intervening between the skis.

U.S. Pat. No. 4,871,337 issued to Harris on Oct. 3, 1989 shows a single ski board (or a water ski board) with a channel section in the ski board and a pair of rider support plates mounted on the ski board and adapted to be longitudinally movable within the track. Harris does not show two skis mounted together back-to-back. By contrast, the device of the instant invention shows two skis mounted back to back.

U.S. Pat. No. 4,951,960 issued to Sadler on Aug. 28, 1990 shows a singular snowboard with an elongated recess extending longitudinally from the rear of the singular snowboard to the midsection of the snowboard to provide left and right portions relative to each other and adapted to flex relative to each other. By contrast, the device of the instant invention shows two ski mounted back-to-back with no recess.

U.S. Pat. No. 5,249,816 issued to Southworth on Oct. 5, 1993 shows a pair of skis mounted back to back and separated by a gap with a riding platform mounted to each of the skis by a bracket. By contrast, the instant invention shows two skis mounted back to back without a gap.

U.S. Pat. No. 4,163,565 issued to Weber on Aug. 7, 1979 shows a pair of skis mounted back to back with an elastic strap mounted between the rear end of the forward runner and the rear end of the rearward runner. There is no securement between the front and rear skis since the inventor wanted the skis to flex sideways by virtue of the elastic strap. The support platform is mounted to each ski by a clamp.

It will be noted that all the prior art devices do not show a pair of skis mounted back-to-back with no gap intervening each ski. Furthermore, the invention shows a clamp member mounted in channels of each ski to secure each ski together and snowshoes mounted on the clamp for the rider's feet to be positionable within the bindings to support the rider in a generally upright position.

None of the above inventions and patents, taken either singly or in combination, is seen to describe the instant invention as claimed.

SUMMARY OF THE INVENTION

Briefly, the invention comprises a pair of snowshoes or skis which are used by each foot of the user to go up a slope.

Then each ski is mounted back-to-back and secured by clamps which hold the binding section and shoes together to form one snowboard or riding surface rather than two. Snowshoe bindings are mounted on the clamps which uses an integral crampon.

Accordingly, it is a principal object of the invention to provide a new and improved snowboard/snowshoe which overcomes the disadvantages of the prior art in a simple but effective manner.

It is a major object of this invention to provide a snowboard/snowshoe which is used separately as a snowshoe and as a ski for cross country and going up the slopes.

It is another object of the invention to provide a snowboard/snowshoe which is connected together and used as a snowboard to descend a snow slope.

It is another object of the invention to provide a snowboard mounted back-to-back without a gap in order to provide a singular distinct bottom surface.

Finally, it is a general object of the invention to provide an improved snowboard/snowshoe and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
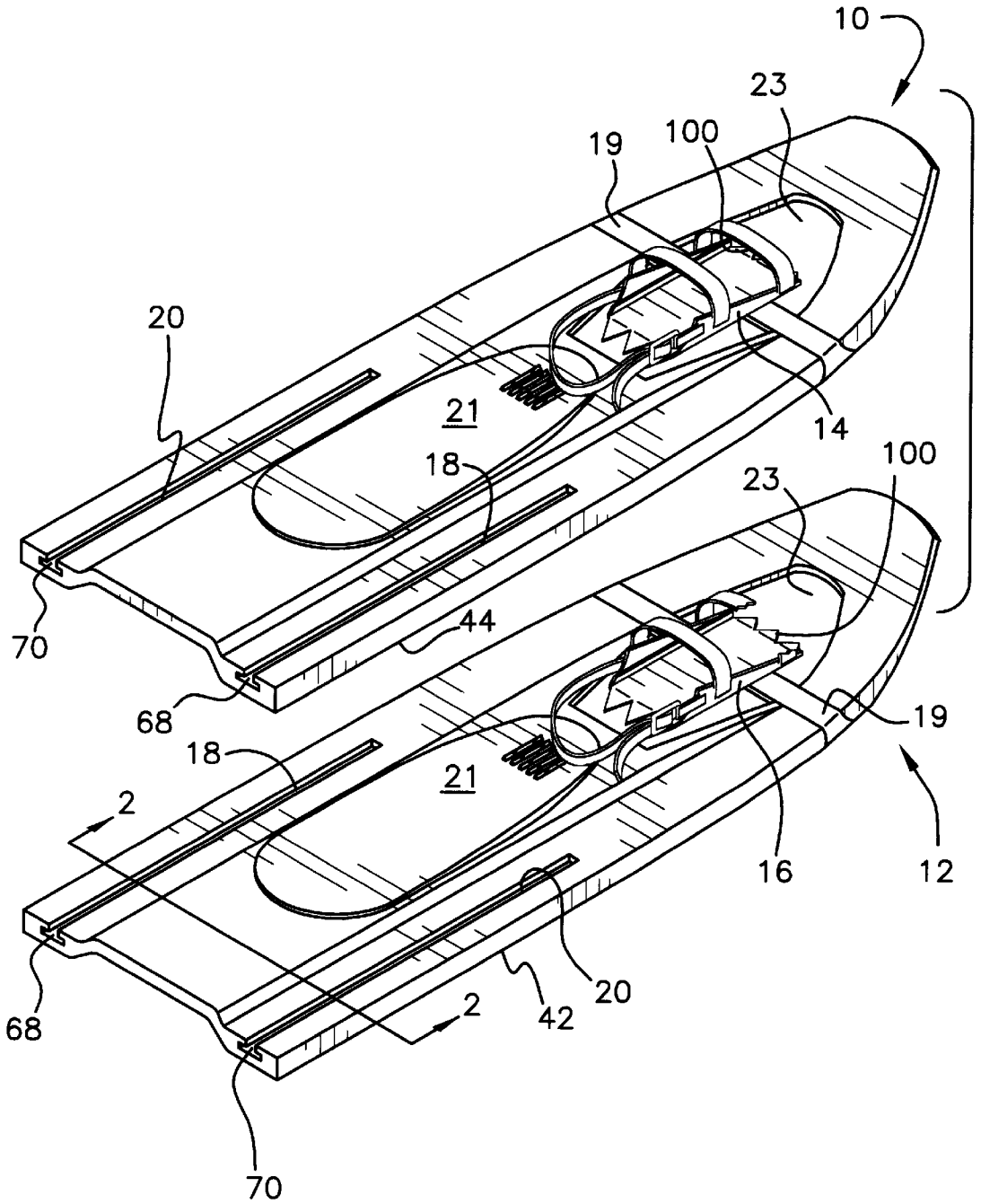
FIG. 1 is perspective view of a pair of skis.
Figure 5:
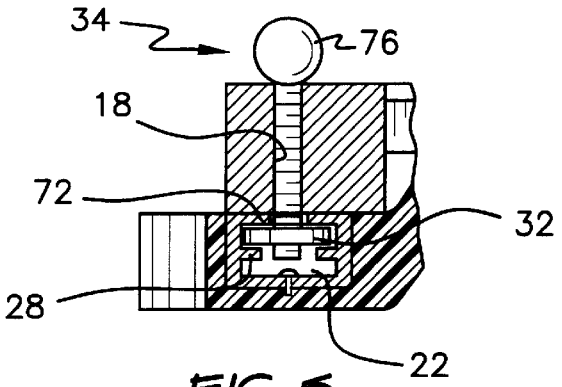
FIG. 5 is a partial cross-sectional view of the clamp attached to the channel shown in FIG. 2.
Figure 3:
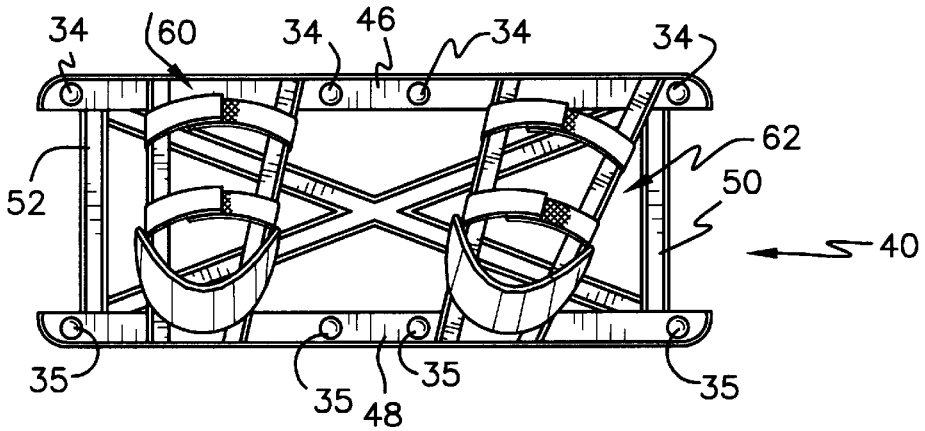
FIG. 3 is a top view of the binding bracket.
Figure 2:
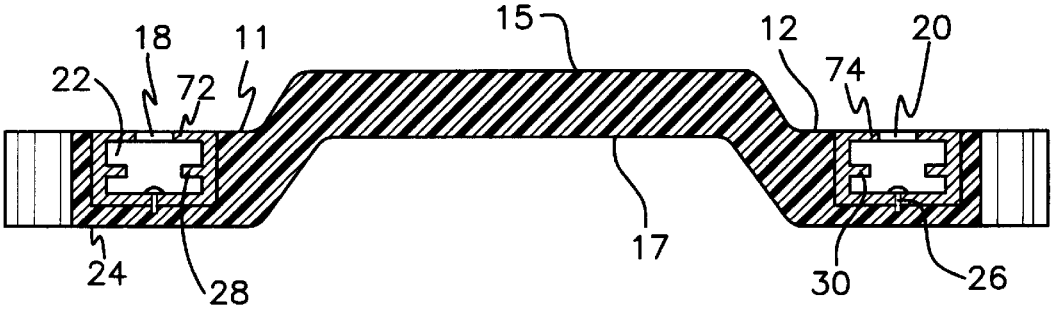
FIG. 2 is a partial cross-sectional view of the embodiment of FIG. 1.
Figure 7:
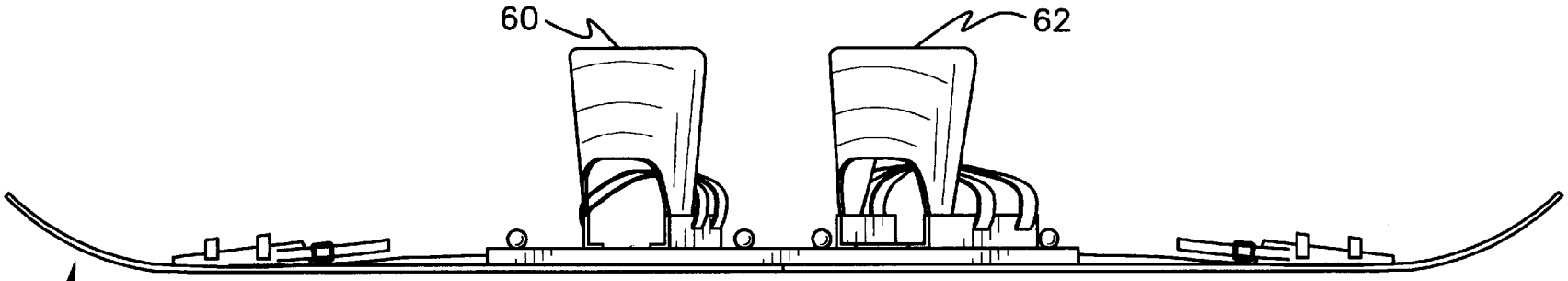
FIG. 7 is a side view of the pair of skis mounted back-to-back with no gap therebetween.
Figure 6:
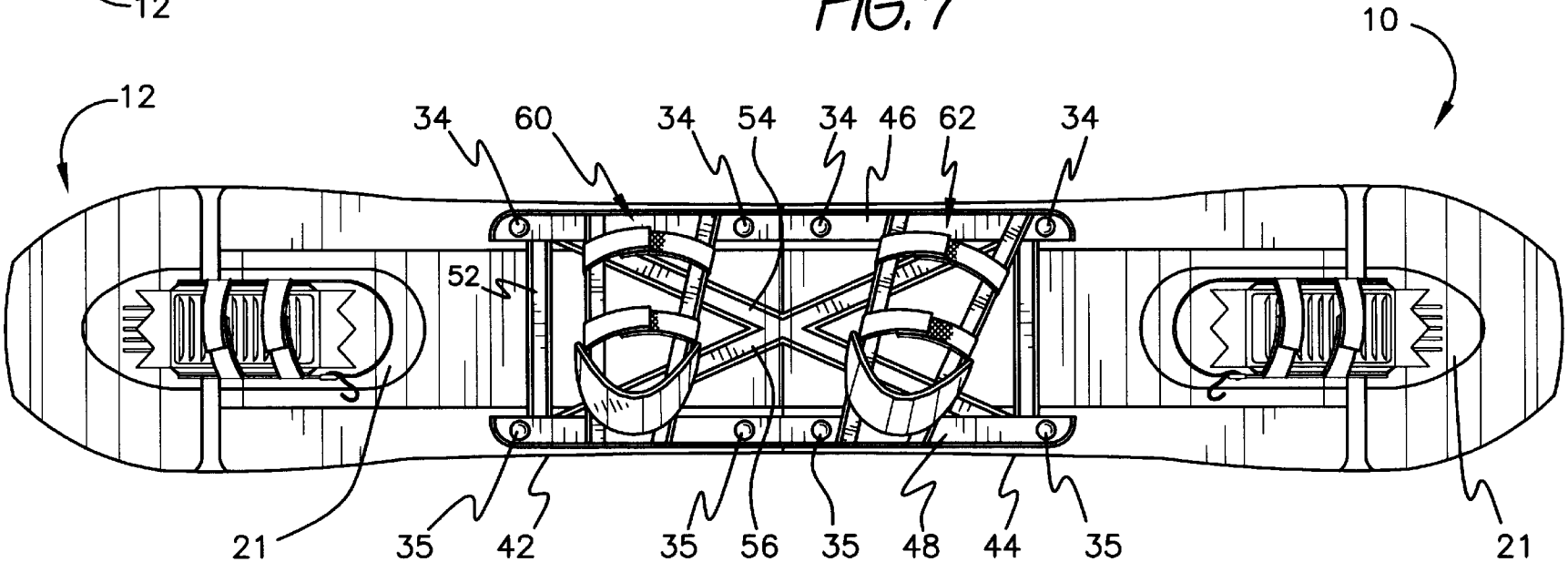
FIG. 6 is a top view of the pair of skis mounted back-to-back with no gap therebetween and connected thereto by the binding bracket shown in FIG. 4.

With reference to FIG. 1, the present invention comprises a pair of skis or snowshoes 10, 12 utilized by the skier going up the slope of a hill. Each ski or snowshoe comprises a two inch riding rail 11, 12 on either side of the board, where a majority of the rider's weight is transmitted. As shown in FIG. 2 each snowshoe is raised between each side rail to form a flat surface 15 and a concave bottom surface 17 for the purpose of reducing board weight significantly. Conventional snowshoe bindings 14, 16 are mounted to each snowboard to a cross member 19. Each snowshoe binding 14, 16 has toe and heel crampons mounted on each snowshoe binding. These toe and heel crampons are indicated at 100 and 110, respectively, in FIG. 1. As shown in FIG. 1 and FIG. 3 each snowshoe binding has conventional flexible straps to hold the shoe of the user, not shown. Cross member 19 is a rubber band that allows snowshoe binding to move up when the sliding plate 21 is moved forward over the opening 23. Although the preferred embodiment discloses a rubber band as the flexible cross member, other flexible material such as webbing or plastic is capable of holding the shoe of the user to the binding. The sliding plate 21 is adapted to move forward to cover the hole 23 for downhill use as shown in FIG. 6, and adapted to slide back for walking up the slope, as shown in FIG. 1. The sliding plate 21 may be made of any material that is flexible, however plastic is favorable. The forward end of the sliding plate 21 has teeth which function as a heel plate. A cross-section of the ski or snowshoe is shown in FIG. 2 which comprises channel sections 18, 20 mounted on each side of the snowshoe. Each channel section comprises a channel bar with a longitudinal recess 22 with the bottom of the channel section mounted to each snowshoe by conventional means such as screws 24, 26. However, it is within the context of one skilled in the art that other fasteners can be applied to secure the channel section to the snowshoe.

Each channel section comprises spaced ledges 28, 30 and upper flanges 72, 74, which support a retaining member 32 attached to a fastening means 34 as shown in FIG. 6. A plurality of fastening means 34 secures the binding bracket 40 shown in FIG. 3 to the back ends 42, 44 of each snowshoe by securing the fastening means to the riding rails of each snowshoe as shown in FIG. 6. It is realized that combining each snowshoe back-to-back provides a singular snowboard which the user can descend the snow slopes. It is also realized that no gap exists between the back ends of each snowshoe when they are connected back-to-back, thus preventing snow or debris from entering the connection between the back ends of each snowshoe.

The binding bracket comprises a pair of side members with 46, 48 with a raised midsection 50, 52 at each end of the binding bracket 40. Cross members 54, 56 connect each side member 46, 48 to provide a stable unit. A pair of conventional bindings 60, 62 are mounted to the binding bracket 40 by conventional means, such as screws or glue.

The shoe portion can be made of a skin frame type structure with materials such as wood/epoxy composite, or the mid section covered with a thin layer of high density polyethylene, or a polyethylene base or the shoe portion can be made of a mono-layer plastic. The main feature is its light weight and differs form current boards by its reduced thickness of the inner area. This reduces the overall board weight significantly. A two inch riding rail on either side of the board transmits the majority of rider's weight.

The raised mid section creates a gripping action when the board is stopped perpendicular to the incline of the slope. It is much easier to stand and rest on an incline with the raised midsection than with a flat bottom. The raised and curved midsection also sheds snow quicker, and the reduction of material in the center allows this area to change temperature quickly which prevents snow from freezing on the bottom surface of the snowshoe.

OPERATION

Figure 4:
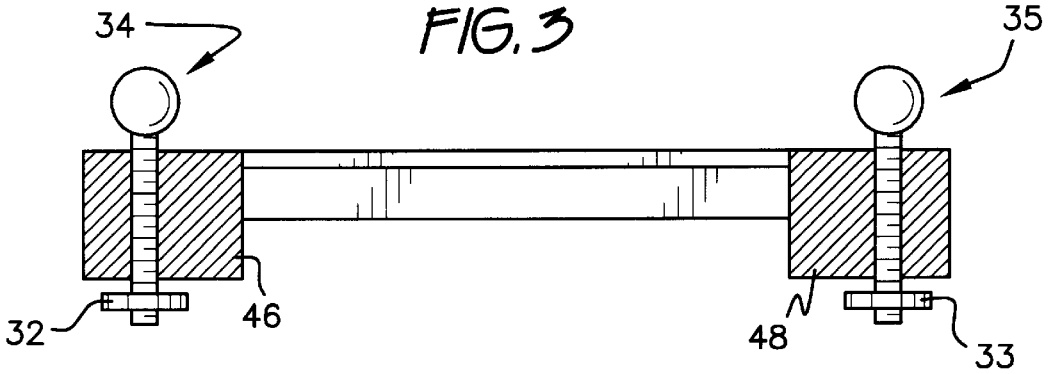
FIG. 4 is a cross-sectional view of the binding bracket.

In operation, the user will apply a right and left snowshoe to a right and left foot, respectively, for going up the snow slope. The sliding door 21 is opened to allow binding crampons to bite into the snow when going up the slope. The mounting bracket 40 will be carried separately by the user. At the top of the slope, the user will take each snowshoe, slide the door 21 closed and connect each snowshoe back-to-back. The mounting bracket 40 is connected to the back ends 42, 44 of each snowshoe by sliding the fastening means 34, 35, shown in FIG. 4 to the open ends 68, 70 of the channels 18, 20 and making sure that retaining member 32 is between the spaced ledges 28, 30 and the upper flanges 72, 74. The knob 76 on the fastening means is turned to secure the binding clamp 40 to the snowshoes 10, 12 to provide a functional singular snowboard. The user then inserts a foot into each of the bindings 60, 62 and proceeds down the slope of a hill.

It is to be understood that the provided illustrative examples are by no means exhaustive of the many possible uses for my invention.

From the foregoing description, one skilled in the art can easily ascertain the essential characteristics of this invention and, without departing from the spirit and scope thereof, can make various changes and modifications of the invention to adapt it to various usages and conditions. For example, the artisan could easily provide a conventional snowshoe, i.e. without a sliding door to close the recess in order to go up the slope, or a conventional snowshoe without the raised midsection or without a concave recess on the bottom of the snowshoe.

It is to be understood that the present invention is not limited to the sole embodiment described above, but encompasses any and all embodiments within the scope of the following claims:

I claim:

1. A combination snowshoe and snowboard apparatus for both ascending and descending a snow covered slope comprising:

a first and a second snowshoe element, each said first and said second snowshoe element including crampons, said crampons being selectively engageable with the snow surface;

a connecting element for removably attaching said first and said second snowshoe element one to the other such that a generally smooth bottom surface is formed; whereby said first and said second snowshoe elements are adapted to be placed on a user's feet and said crampons are adapted to be selectively brought into engagement with the snow surface, thus providing traction on the snow surface and further where said first and said second snowshoe elements are adapted to be attached one to the other by said connecting element and said crampons are adapted to be selectively removed from contact with the snow surface, the resulting generally smooth bottom surface enables the user to slide over a snow covered slope.

2. The combination snowshoe and snowboard according to claim 1 wherein each said selectively engageable crampon comprises a moveable panel on a top surface of each said first and said second snowshoe element, said moveable panel having a first position wherein an aperture is exposed, each said aperture extending completely through said first and said second snowshoe element and where each said selectively engageable crampon further comprises a foot platform with downwardly depending snow engaging members, each said foot platform being disposed over a respective one of said apertures and each said foot platform is resiliently mounted to a respective one of said first and said second snowshoe element such that when said moveable panels are in said first position, said downwardly depending snow engaging members extend through said first and said second snowshoe members to engage the snow, and where each said moveable panel has a second position where said moveable panel completely covers said aperture and said foot platform rests on top of said moveable panel.

3. The combination snowshoe and snowboard according to claim 1, wherein said connecting element includes attachment means, said attachment means comprising cooperating keyhole slots and attachment members, said keyhole slots being disposed on the upper surface of said first and said second snowshoe elements, said attachment members fitting into said keyhole slots such that said first and said second snowshoe members are engaged and held one to the other in a back to back relationship.

4. The combination snowshoe and snowboard according to claim 1, wherein each said first and said second snowshoe element has a concave bottom surface.

5. The combination snowshoe and snowboard according to claim 1, wherein each said first and said second snowshoe element has thickened lateral edges to distribute the user's weight.

6. The combination snowshoe and snowboard according to claim 1, wherein said connecting element includes attachment means for the user's feet.

* * * * *